United States Patent [19]

Parker

[11] Patent Number: 4,872,664

[45] Date of Patent: Oct. 10, 1989

[54] TREADMILL HAVING IMPROVED DECK

[76] Inventor: Robert Parker, 12061 Tavel Cir., Dallas, Tex. 75230

[21] Appl. No.: 128,223

[22] Filed: Dec. 3, 1987

[51] Int. Cl.[4] ..... A63B 23/06; B05D 1/36

[52] U.S. Cl. ..... 272/69; 428/402

[58] Field of Search ..... 272/69, 93, 1 R, 56.5 R, 272/56.5 SS, 70; 428/402, 403, 392, 484; 525/171; 119/29

[56] References Cited

U.S. PATENT DOCUMENTS

| | | | |
|---|---|---|---|
| 3,659,845 | 5/1972 | Quinton | 272/69 |
| 3,731,917 | 5/1973 | Townsend | 272/69 |
| 4,445,683 | 5/1984 | Ogden | 272/69 |

*Primary Examiner*—S. R. Crow

*Attorney, Agent, or Firm*—Johnson & Gibbs

[57] ABSTRACT

A treadmill having an endless belt mounted upon an underlying support surface for rotation thereover, the underlying support surface having a curable coating composition applied thereto to improve the performance and efficiency of the treadmill. The coating composition consists essentially of from about 30 to about 50 volume percent of a polymeric resin, from about 30 to about 60 volume percent of a wax compatible with the polymeric resin, and from about 2 to about 12 volume percent of a particulate constituent selected from the group consisting of metal and melamine. The coating composition can also include a fibrous mat disposed over the underlying support surface of the treadmill.

12 Claims, 1 Drawing Sheet

TREADMILL HAVING IMPROVED DECK

BACKGROUND OF THE INVENTION

1. Field of the Invention

The present invention relates to treadmills, and more particularly but not by way of limitation, to a treadmill having a low-friction coating on the deck portion for enhancing the lubricity and wear characteristics of the deck portion, while at the same time lowering the resistance to belt movement thereacross.

2. History of the Prior Art

Treadmills have long been used in health clubs and the home as exercising devices. Further, the prior art is replete with wear resistance surface coatings. Such coatings are used for many applications including coating planar members adapted for supporting conveyor belts, treadmill belts and the like. In the main, these coatings are adapted for affording durability, long wear and reducing friction as the belt moves across the deck portion of the treadmill. The aspects of low friction and durability allow a conveyor belt or treadmill to operate with greater efficiency and less cost. Likewise, there are a myriad of treadmill designs which incorporate a variety of support surface configurations for reducing friction on the belt. The present invention pertains to this area of technology and provides a marked advance.

Treadmills have been available for many years to those individuals wishing to exercise by running in a confined space. The treadmill generally includes an endless belt having at least one surface with a high coefficient of friction to prevent the user from slipping. The surface beneath the belt has included rollers and smooth planar structures, such as boards, which allow the runner's feet to engage the treadmill surface and move relative to the underlying support. When the treadmill is properly designed, the drive motor is able to maintain the uniformity of speed of the belt with a variety of runner sizes, weights and running styles. Improper wear and/or increased resistance of the belt causes serious problems with such treadmills and can result in overload of the motor and/or personal injury to the user.

The coating of treadmill support surfaces and the underlying surfaces of conveyor belts, moving sidewalks and the like have found widespread recognition as an area in need of technological development. Numerous compositions have been formulated by the prior art for affording strength, durability and reduced friction. These coatings are generally applied directly to the underlying surfaces of the treadmills for preventing the deterioration thereof while affording enhanced low-friction characteristics. One of the measures of treadmill efficiency is the amount of current drawn by the treadmill motor during loading applications. Increases in the amount of current needed to drive a treadmill at a fixed rate indicates a deterioration in the underlying surface resulting in a higher coefficient of friction and oftentimes deleterious wear for both the belt and the surface. Smooth coatings, such as wax finishes, reduce the amount of frictional resistance for a short period of time. However, prolonged use causes substantial wear to the wax and ultimately a wax build up in the system. This leads to decreased surface lubricity of the originally waxed surface.

The prior art is also replete with the teaching of surface coatings and compositions affording strong, resilient surfaces having a low coefficient of friction. One such example is set forth and shown in U.S. Pat. No. 3,726,817 issued in 1973 to Niswonger. A curable surface coating composition is taught therein which comprises an unsaturated polyester resin, natural wax particles and flock. The before-mentioned ingredients are mixed with a curing catalyst, such as methyl ethyl ketone peroxide, and poured or sprayed as a thin film onto the particular substrate. The composition is particularly adapted for use as a skating surface; and the cured coating is waterproof and strongly bonded to the substrate. The specificity with which such compositions are blended is adequately set forth.

The unsaturated polyester resin of the Niswonger composition is of a conventional variety being an organic acid or anhydride thereof, e.g., an alkylene glycol condensation product wherein the acid (anhydride) and glycol are present in approximately equimolar portions. Such resins are generally made by reacting a mixture of aliphatic unsaturated acid or anhydride (such as maleic acid, maleic anhydride or furmaric acid) and a saturated aliphatic acid or aromatic acid or anhydric thereof (such as phthalic acid, phthalic anhydride and the like wherein the mol ratio of unsaturated acid to aromatic or saturated acid is in the range of 2:1 and 1:2). These details are set forth in column 2 of the Niswonger patent.

The wax used is any natural wax which is normally solid and which melts at the temperature reached during the resin curing and thereby distributes itself evenly throughout the coating. It is obviously important to provide an homogeneous coating which the aforesaid compositions provide. The wax therein makes the coating waterproof and it is therein stated that it is believed that the wax acts as a plasticizer and causes the coating to have a lower coefficient of friction than if it were made only of cured resin solution. With the resin solution, wax, and flock a UV stabilizer is blended to form a mixture for uniform application.

Similarly, Koellisch U.S. Pat. No. 4,025,676 teaches a composite skid construction for moving heavy objects. It has been stated to be found that impregnating material, such as a matted or compressed fabric formed of numerous types of synthetic fibers and material including rayon, nylon and polypropylene and polyester, can be impregnated with a wax to greatly enhance the ease in moving supporting objects. Such wax is granulated and is the type used for bowling alleys and the like.

Numerous other patents address coatings for reducing the coefficient of friction on surfaces for purposes of facilitating sliding thereacross. U.S. Pat. Nos. 3,753,769 and 4,058,649, issued to Steiner, disclose a coating material consisting of an interpolymer and a slip agent and/or a cold slip antiblocking finely divided wax. U.S. Pat. No. 4,201,826, issued to Nylander, discloses polyester compositions useful in making multilayer laminates. Glass fiber reinforcements are suggested therein. U.S. Pat. No. 3,498,826, issued to Caroselli et al., discloses the application of a solid organic lubricating material (such as teflon) to fiber glass in combination with a resinous binder. U.S. Pat. No. 3,165,567, issued to Olson, discloses impregnating the surface of a resin with lubricating particles. U.S. Pat. No. 2,784,223, issued to Caroselli, discloses coating glass fibers with a finely divided teflon in a resin. These patent references manifest the interest to which the technology of the prior art has advanced. The utilization of a hard and durable coating provided in a lower coefficient of friction and high lubricity is seen to be desirable. Each composition, however, provides various parameters of durability, hardness, lubricity, impact resistance and wear resistance. For use in treadmills and the like wherein a continuous belt moves over the coated surface with intermittent impact loading thereacross, the aspects of durability and wear resistance in combination with high lubricity are critical considerations.

A permanent coating is thus needed for treadmills, conveyor belts and the like which provides a lower coefficient of friction with high lubricity. The coating composition must be durable and have the propensity to wear evenly while becoming smoother throughout the life of the coated surface. The present invention provides such an advance over the prior art through the utilization of a composition consisting essentially of a polymeric resin, wax and a particulate material selected from the group consisting of metal and melamine, such composition manifesting high lubricity and durability.

SUMMARY OF THE INVENTION

The present invention relates to a treadmill of the type wherein an endless belt is mounted upon an underlying support surface for rotation thereover. The underlying support surface (or deck portion as sometimes called) is designed to receive the weight of the person using the treadmill and running thereupon. To improve the utility of the treadmill, a curable coating composition is applied to the underlying support surface, the coating composition comprising a polymeric blend consisting essentially of from about 30 to about 60 volume percent of a polymeric resin, from about 30 to about 60 volume percent of a wax compatible with the polymeric resin, and from about 2 to about 12 volume percent of a particulate constituent selected from the group consisting of metal and melamine. The coating when applied to the underlying support surface and cured, provides the underlying support surface with enhanced lubricity for low-resistance to belt movement thereacross and a high durability to abrasion.

The curable coating applied to the underlying support surface of the treadmill for rotation of the endless belt therealong can further comprise a fibrous matt supported on the underlying support surface. The fibrous matt is impregnated with the resinous mixture, (i.e., the mixture of the polymeric resin, the wax and the particulate metal or the particulate malamine) such that the matt is secured to the underlying support surface. Thus, the fibrous matt enhances the durability and strength of the curable coating and permits one to use wood and the like as the treadmill deck portion or underlying support surface. The utilization of the low friction coating compositions of high durability of the present invention affords reduced resistance to the movement of the belt across the deck portion, particularly in treadmill applicatons where repeated orthogonal weight is applied thereto by a runner thereon. Increased efficiency and decreased power requirements of the treadmill are achieved because the surface coating has a propensity of becoming smoother and shinier as the belt travels thereacross. Thus, by coating a deck portion of the treadmill with the curable coating compositions of the present invention one can construct treadmills and conveyor belts having increased durability and efficiency with a minimum of cost.

An object of the present invention is to provide an improved treadmill.

Another object of the present invention, while achieving the before stated object, is to provide a treadmill wherein the deck portion of the treadmill has enhanced lubricity for low resistance to belt movement thereacross and high durability to abrasion.

Another object of the present invention, while achieving the before stated objects, is to provide an improved coating composition for the underlying support surface of a treadmill which will enhance and improve the lubricity of the support surface for movement of the belt thereacross, while at the same time being durable to abrasion.

These and other objects, advantages and features of the present invention become apparent to those skilled in the art from a reading of the following detailed description when viewed in conjunction with the drawings and appended claims.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
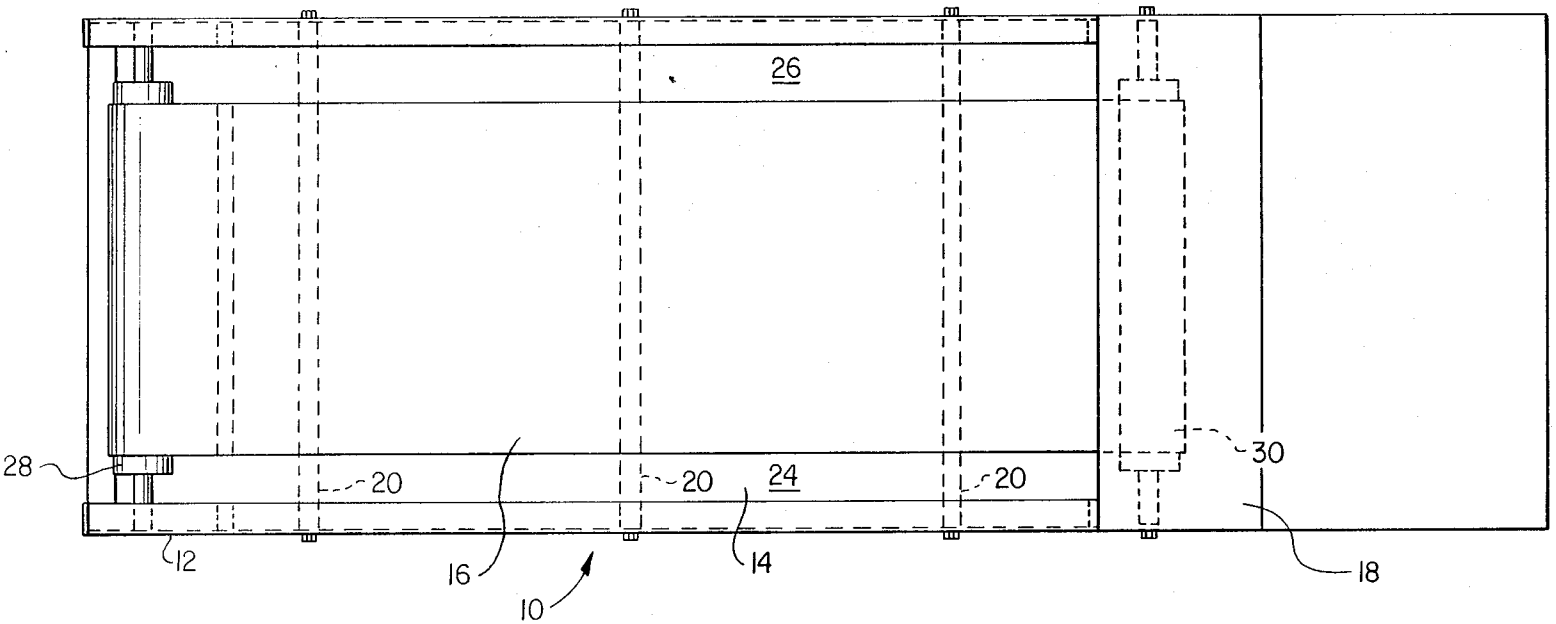
FIG. 1 is a top plan view of a treadmill constructed in accordance with the principles of the present invention.
Figure 2:
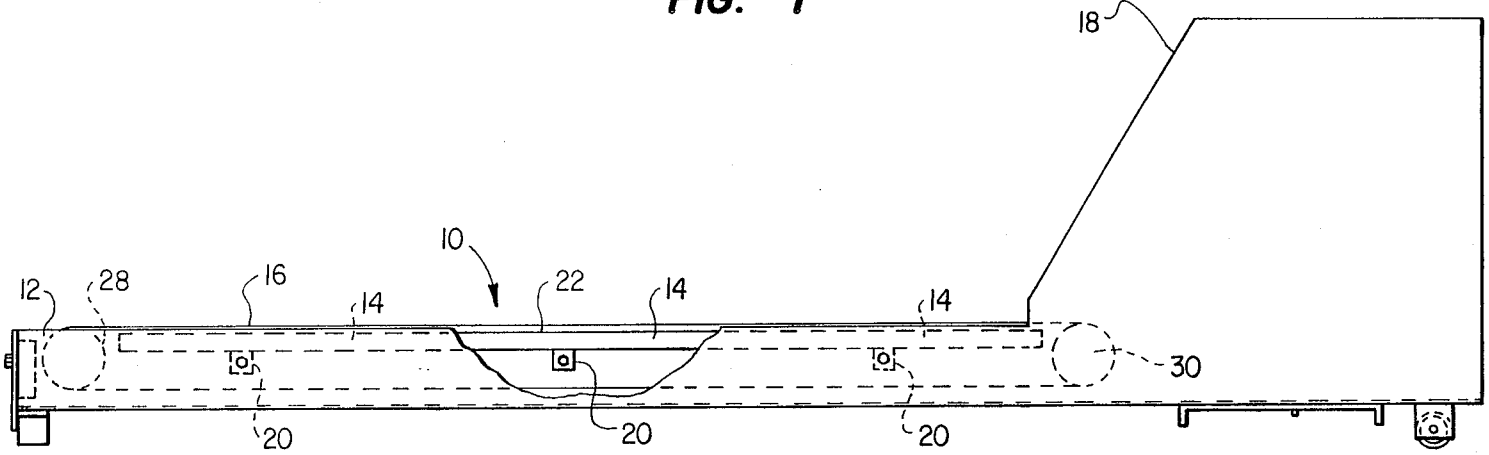
FIG. 2 is a partially cutaway, side-elevational view of a portion of the treadmill belt area illustrating the region of the coating and the advantages of the lubricity thereof.

Referring now to the drawings, a treadmill 10 is illustrated. The treadmill 10 comprises a frame 12, a deck portion 14 upon which an endless conveyor belt 16 is disposed, and a control panel 18. The deck portion 14 is secured to the frame 12 via a plurality of support members 20; whereas, the control panel 18 is secured to the frontal region of the treadmill 10 by upstanding support rails (not shown) and the frame 12.

The deck portion 14 includes an underlying support surface 22 (which is disposed beneath the conveyor belt 16) and lateral portions 24 and 26. Thus, the conveyor belt 16 is more narrow than the underlying support surface 22 of the deck portion 14. A roller 28 is disposed at the rearward end of the deck portion 14; and a roller 30 is disposed at the forward end of the deck portion 14. Thus, the rollers 28 and 30 cooperate with the deck portion 14 to provide a means for supporting the conveyor belt 16, and thus a jogger thereon.

The configuration of the treadmill 10 permits the jogger to control the pace, the level of the deck portion 14 during exercise and to monitor speed as well as other exercising parameters. Further, the treadmill 10 as heretofore described is a conventional item well known in the art. Thus, no further comments as to the construction of the treadmill 10 are believed necessary to enable one to fully understand the subject invention.

As heretofore stated, theefficiency of the treadmill 10, including the longevity of the useful life of the conveyor belt 16, can be improved if the underlying support surface 22 of the deck portion 14 can be modified with a permanent coating composition having a low coefficient of friction and high lubricity. Further, the coating composition, in combination with the underlying surface, must possess durable prooperties and have a propensity to wear evenly while becoming smoother throughout the life of the coated surface.

The coating compositions useful in improving the lubricity of the deck portion 14 of the treadmill 10 in accordance with the present invention consists essentially from about 30 to about 60 volume percent of a polymeric resin, from about 30 to about 60 volume percent of a wax, and from about 2 to about 12 volume percent of a particulate material. The polymeric resin constituent and the wax constituent must be capable of being cured into a hard durable surface in order to enhance lubricity of the deck portion of the treadmill for low resistance to the belt movement thereacross, while the same time being highly durable to abrasion. On the other hand, the particulate constituent, i.e., the metal or melamine particles, must be compatible with the resin and wax constituents, while at the same time being in a finely divided state of less than about 100 microns in diameter.

Any resinous polymeric material which is curable in the presence of wax, and which is compatible with the wax can be employed in the formulation of the coating compositions of the present invention. Further, the resinous polymeric materials can be thermosetting or thermoplastic materials. Typical of such materials are phenol formaldehyde and phenol furfural compounds, ureaformaldehyde compounds, vinyl resins, nylon plastics, cellulose derived plastics, epoxy resins, urethane resins, such as polyurethane, and other suitable plastic materials and mixtures thereon.

In many instances, in order to cure the resinous material, it is necessary to incorporate into the resulting blend of the polymeric resin, the wax, and the particulate constituent, an amount of catalyst effective to cure the resinous material. The amount of catalyst effective to cure the resinous material can vary widely depending to a large degree on the composition of the resinous material and the catalyst. Such resinous materials are well-known in the coating art, as well as the amount of catalyst effective to cure such resinous materials. Thus, no further comments are believed necessary concerning the identity of the resinous materials, the identity of the catalyst, or the amount of catalyst employed to effectively cure the resinous material or a blend containing same in order to enable one to formulate the coating compositions for use on the underlying support surface of a treadmill in accordance with the present invention.

The wax used in the coating composition for improving the lubricity of the underlying support surface of the treadmill may be any natural or synthetic wax which will distribute itself evenly throughout the coating by either suspension or melting. Typical of such natural waxes are carnauba wax, monta wax, and candilla wax; whereas typical of synthetic waxes are homopolymers of ethylene having an average molecular weight of from about 500 to about 2000. Examples of synthetic waxes satisfying the criteria for use in the formation of the coating compositions for use on the underlying support surface of a treadmill in accordance with the present invention are the PolyWax's which are polyethylenes (homopolyers of ethylene) produced by Bareco division of Petrolite Corporation, Tulsa, Okla. under the trade names POLYWAX 500, POLYWAX 655, POLYWAX 1000, and POLYWAX 2000.

To improve the dispersibility of the wax component throughout the resinous material of the coating composition, the wax component is desirably in granulated or powder form and has an average particle size of less than about 100 microns, more desirably about 6 microns or less in size. However, one should appreciate that the particle size is not critical provided that a uniform dispersion of the wax throughout the resinous material can be achieved at the temperatures where curing of the composition occurs.

The third component of the coating composition, which enhances the durability of the coating composition, is the particulate metal or particulate melamine dispersed throughout the resulting mixture of the resinous material and the wax. Any suitable metal having desired abrasive resistant properties can be employed, such as stainless steel powder or shavings. However, to insure that the particulate metal or the particulate melamine is uniformly dispersed throughout the mixture of the resinous material, and the wax, and to further insure the formation of the smooth and uniform coating surface on the underlying support surface of the treadmill, the size of the particulate metal or the particulate melamine is desirably less than about 100 microns, and more desirably about 6 microns or less in size. Any suitable commercial particulate metal having a size of less than about 100 microns, and possessing the desired abrasive resistant characteristics set forth above can be employed as the particulate metal component of the coating compositions of the present invention. Further, any desirable particulate melamine can be employed as the particulate constituent of the coating composition of the present invention. However, desirable results have been obtained wherein the particulate melamine constituent comprises superfine melamine crystals manufactured by Melamine Chemicals, Inc., of Donaldsonville, LA 70346.

To further enhance the abrasive resistance properties of the coating compositions for use on the underlying support surface of a treadmill, the coating composition will desirably contain a matted fiber fabric positionable over a selected area of the underlying support surface. Any suitable matted fabric can be employed provided that the fabric permits the resinous composition to impregnate the material so that the material can be adhered to the underlying support surface of the treadmill; while providing sufficient resinous composition on the surface thereof to provide the desired surface to reduce friction and enhance lubricity of the underlying support surface as the belt travels therealong. While any suitable fabric satisfying the above requirements can be employed, especially desirable results have been obtained wherein the fabric incorporated into the coating composition is a fiberglass fabric or fibers thereof, canvas materials and the like.

Any suitable method can be employed for applying the curable coating on the underlying support surface of the treadmill. For example, once the curable coating consisting of the desired amounts of the polymeric resin, wax and particulate metal has been formulated, the coating can be rolled, brushed, sprayed or otherwise applied to the underlying support surface and thereafter smoothed with a trowel or other suitable instrument to ensure a substantially uniform thickness of the coating thereon. The thickness of the coating can vary widely and will be dependent to a large degree upon the material from which the underlying support surface is fabricated. However, care must be exercised to prevent the coating from becoming too thick as such will cause the surface to crack during use. Thus, it is generally desirable that an effective amount of the coating be applied to the underlying support surface to provide same with an effective amount of the coating so that the coating, after curing, has a thickness from about 0.5 to about 10 millimeters.

When it is determined that the abrasive resistant properties should be further improved by the incorporation of the matted fiber fabric, such as fiberglass or canvas material, an effective amount of the curable coating composition is first applied to the underlying support surface of the treadmill. Prior to setting of the curable compound, the mat is positioned on the coated underlying support surface and thereafter additional coating composition is applied to the matted fiber fabric by any suitable means such as a roller, brush, trowel or the like to ensure that a substantially uniform thickness of the coating composition has been applied, and that the resulting surface is substantially smooth.

In order to further explain the present invention, the following example is given. However, it is to be understood that the example is for illustrative purposes only and is not to be construed as limiting the scope of the present invention as defined in the appended claims.

EXAMPLE I

Four commercially available treadmills (Pacer Fast Track Treadmills model R3D, manufactured by Pacer Industries, Inc., Dallas, Tex.) were tested in a health club for a period of about four months. The underlying support surface (i.e., deck) of one of the treadmills was coated with a coating composition in accordance with the present invention, the other three treadmills being of conventional construction. The composition applied to the deck of the treadmill contained 47 volume percent polyurethane, 47 volume percent of a powdered wax having an average particle size of about 6 microns, and 6 volume percent stainless steel filings having an average particle size of about 6 microns.

Once the coating composition had been formulated, an effective amount of the coating composition was applied to the underlying support surface of the treadmill with a roller to sufficiently cover the underlying support surface. Thereafter, prior to curing a fiberglass matt was positioned on the coated underlying support surface and an additional amount of the coating composition was applied to the fiberglass matt, taking care to insure that the coating composition substantially impregnated the fiberglass matt and provided a resulting coating having an averge thickness of about 1 millimeter. The coating composition was worked with a trowel to insure the formation of a smooth and uniform surface.

The coating composition, which contained an amount of a catalyst effective to cure the polyurethane resin, was allowed to cure under ambient conditions. Once cured, the treadmill belt was placed in its normal position over the coated underlying support surface, and the modified treadmill was tested with the three conventional treadmills under similar conditions. The conventional treadmills under full load had a current draw of between 14 and 19 amps. The same measurements made on the treadmill having the underlying support surface coated with the curable coating composition as prepared in accordance with this Example I had a current draw of 12–16 amps. Thus, by employing the coating composition of the present invention on the underlying support surface of a trreadmill the slider bed design of a treadmill uses less power because it develops less friction than the standard slider bed. Further, visual observations indicate that the coated underlying support surface had less wear to abrasion due to movement of the belt therealong than the treadmills of conventional construction.

EXAMPLE II

One of the treadmills tested in the procedure of Example I was modified by replacing the deck and the composition used to coat the deck contained 9.7 volume percent melamine particles (i.e., Superfine melamine crystals manufactured by Melamine Chemicals, Inc., of Donaldsonville, LA), 41 volume percent of a powder wax constituent (Petrolite 2000J powdered wax produced by Bareco division of Petrolite Corporation, Tulsa, OK) and 49.3 volume percent of a polyester resin (i.e., polyurethane). An appropriate amount of catalyst (hardener) was incorporated into the mixture to solidify same.

Once the coating composition has been formulated an effective amount of the coating composition was applied to the underlying support surface of the treadmill with a roller to sufficiently cover the underlying support surface. Thereafter, prior to curing a canvas cloth matt was positioned on the coated underlying support surface and an additional amount of the coating composition was applied to the matt, taking care to insure that the coating composition substantially impregnated the canvas cloth matt and provided a resulting coating having an average thickness of about 1 millimeter. The coating composition was worked with a trowel to insure the formation of a smooth and uniform surface.

The coated deck was then allowed to cure under ambient conditions. Once cured, the treadmill belt was placed in its normal position over the coated underlying support surface, and the modified treadmill tested. As before stated, conventional treadmills under full load have a current draw of between 14 and 19 amps. The same measurements made on the treadmill having the underlying support surface coated with the curable coating composition as set forth in this Example II had a current draw of 12–16 amps. Further, evidence indicates that a surface coated with a composition containing particulate melamine as the particulate constituent has improved wearing characteristics, improved lubricity and less noise is created due to the treadmill belt sliding over the coated deck of the treadmill.

The above data clearly indicates the improvements obtained wherein the underlying support surface of a treadmill is coated with the coating composition in accordance with the present invention, especially when particulate melamine is incorporated into a coating composition formulated of a powdered wax and a polyester resin. It should be understood that changes and modifications may be made to the invention as set forth herein without departing from the scope of the invention as defined in the appended claims.

What is claimed is:

1. An improved treadmill of the type wherein an endless belt is mounted upon an underlying support surface for rotation thereover, said underlying support surface being adapted for receiving the weight of a person using the treadmill and running thereupon, the improvement comprises a curable coating composition disposed on said underlying support surface such that upon curing of the coating the underlying support surface exhibits enhanced lubricity for low resistance to belt movement thereacross and high durability to abrasion, said curable coating composition consisting essentially of from about 30 to about 60 volume percent of a polymeric resin, from about 30 to about 60 volume percent of a wax compatible with the polymeric resin, and from about 2 to about 12 volume percent of a particulate constituent selected from the group consisting of metal particles and melamine particles.

2. The treadmill of claim 1 further comprising a fibrous mat positioned on the underlying support surface, said fibrous mat being impregnated with and secured to the underlying support surface by said curable coating composition.

3. The treadmill of claim 1 wherein the underlying support surface is a wood board of substantially planar configuration secured beneath said endless belt in contact therewith.

4. The treadmill of claim 3 wherein said curable coating composition is applied to said board in an amount effective to provide a coating thereon having an average thickness of from about 0.5 to about 10 millimeters.

5. The treadmill of claim 1 wherein said belt of said treadmill is more narrow than said underlying support surface whereby said coating composition is exposed on opposite sides thereof and provides a substantially low friction area for supporting a runner whose feet extend outwardly of said belt.

6. An improved treadmill of the type wherein an endless belt is mounted upon an underlying support surface for rotation thereover, said underlying support surface being adapted for receiving the weight of a person using the treadmill and running thereupon, the improvement comprises a curable coating composition dispsed on said underlying support surface such that upon curing of the coating the underlying support surface exhibits enhanced lubricity for low resistance to belt movement thereacross and high durability to abrasion, said curable coating composition consisting essentially of from about 30 to about 60 volume percent of a polymeric resin, from about 30 to about 60 volume percent of a wax compatible with the polymeric resin, from about 2 to about 12 volume percent of a particulate constituent selected from the group consisting of metal particles and melamine particles, and a fibrous mat positioned on the underlying support surface, said fibrous mat being impregnated with and secured to the underlying support surface by said curable coating composition wherein said particulate constituent of said curable coating composition has an average particle size of less than 100 microns.

7. The treadmill of claim 6 wherein the wax constituent of said curable coating composition is a particulate material having an average particle size of less than about 100 microns.

8. The treadmill of claim 7 wherein the particulate constitute is melamine.

9. The treadmill of claim 7 wherein the particulate constituent is fabricated from a metal.

10. An improved treadmill of the type wherein an endless belt is mounted upon an underlying support surface for rotation thereover, said underlying support surface being adapted for receiving the weight of a person using the treadmill and running thereupon, the improvement comprises a curable coating composition disposed on said underlying support surface such that upon curing of the coating the underlying support surface exhibits enhanced lubricity for low resistance to belt movement thereacross and high durability to abrasion, said curable coating composition consisting essentially of from about 30 to about 60 volume percent of a polymeric resin, from about 30 to about 60 volume percent of a wax compatible with the polymeric resin, from about 2 to about 12 volume percent of a particulate constituent selected from the group consisting of metal particles and melamine particles, and a fibrous mat positioned on the underlying support surface, said fibrous mat being impregnated with and secured to the underlying support surface by said curable coating composition wherein the polymeric resin constituent of curable coating composition is a polyurethane, said curable coating composition containing an amount of catalyst effective to cure said polyurethane, and said wax constituent is a homopolymer of ethylene having an average molecular weight of about 500 to about 200.

11. The treadmill of claim 10 wherein the particulate constituent of said curable coating composition comprises stainless steel particles having an average size of about 6 microns.

12. The treadmill of claim 11 wherein the homopolymer of ethylene comprises particles having an average size of about 6 microns.

* * * * *